US008826498B2

(12) United States Patent
Johnson

(10) Patent No.: US 8,826,498 B2
(45) Date of Patent: Sep. 9, 2014

(54) SLIDER ZIPPER ASSEMBLY WITH OXYGEN SCAVENGING PROPERTIES

(75) Inventor: Joel L. Johnson, Stockbridge, GA (US)

(73) Assignee: Illinois Tool Works Inc., Glenview, IL (US)

( * ) Notice: Subject to any disclaimer, the term of this patent is extended or adjusted under 35 U.S.C. 154(b) by 2052 days.

(21) Appl. No.: 11/442,055

(22) Filed: May 26, 2006

(65) Prior Publication Data

US 2007/0271742 A1 Nov. 29, 2007

(51) Int. Cl.

| | |
|---|---|
| ***A44B 19/16*** | (2006.01) |
| ***B65D 33/25*** | (2006.01) |
| ***B65D 81/26*** | (2006.01) |

(52) U.S. Cl.

CPC ..... *B65D 81/267* (2013.01); *B65D 33/2508* (2013.01); *B65D 33/2591* (2013.01); *B65D 33/2541* (2013.01)

USPC ..... 24/400

(58) Field of Classification Search

USPC ..... 24/399, 400; 383/61.2, 61.3, 63, 64

See application file for complete search history.

(56) References Cited

U.S. PATENT DOCUMENTS

| | | | | |
|---|---|---|---|---|
| 5,492,742 | A | 2/1996 | Zenner et al. | |
| 5,766,706 | A * | 6/1998 | Custer et al. | 428/35.2 |
| 5,859,145 | A | 1/1999 | Ching et al. | |
| 6,390,676 | B1 | 5/2002 | Colombo et al. | |
| 6,499,878 | B1 | 12/2002 | Dobreski et al. | |
| 6,515,067 | B2 * | 2/2003 | Cai et al. | 524/553 |
| 6,713,152 | B2 | 3/2004 | Chen et al. | |
| 7,022,258 | B2 | 4/2006 | Yang et al. | |
| 2003/0118758 | A1 * | 6/2003 | Chen et al. | 428/35.2 |
| 2003/0129331 | A1 * | 7/2003 | Chen et al. | 428/34.2 |
| 2003/0179955 | A1 | 9/2003 | Rehwinkel | |
| 2004/0008613 | A1 | 1/2004 | Beckwith et al. | |
| 2004/0151934 | A1 | 8/2004 | Schwark et al. | |
| 2004/0251164 | A1 * | 12/2004 | Yasuike et al. | 206/524.4 |
| 2005/0022352 | A1 * | 2/2005 | Thomas et al. | 29/409 |
| 2005/0145512 | A1 | 7/2005 | Compton et al. | |
| 2005/0196077 | A1 * | 9/2005 | Ootsubo et al. | 383/64 |
| 2006/0189467 | A1 * | 8/2006 | Rehwinkel et al. | 493/213 |

* cited by examiner

*Primary Examiner* — Robert J Sandy
*Assistant Examiner* — David Upchurch
(74) *Attorney, Agent, or Firm* — McCarter & English, LLP

(57) ABSTRACT

The zipper includes flanges which include an oxygen scavenging polymer. The oxygen scavenging polymer can be a co-extruded layer or blended with other polymers. The oxygen scavenging polymer is activated by ultra-violet light prior to installation by a form fill seal apparatus. This zipper is particularly useful in reducing residual oxygen in the packaging of such food products as cheese and meat, thereby extending the shelf life.

10 Claims, 3 Drawing Sheets

SLIDER ZIPPER ASSEMBLY WITH OXYGEN SCAVENGING PROPERTIES

BACKGROUND OF THE INVENTION

1. Field of the Invention

The present invention relates to a slider zipper assembly which is formed by using oxygen scavenging polymers (OSPs) in the extrusion process. The oxygen scavenging polymer can be a co-extruded layer or can be blended with the other resins to be extruded.

2. Description of the Prior Art

It is well-established that food spoilage can be tied, at least in part, to oxidation. Therefore, it is advantageous, when packaging food or even when reclosing a bag containing food, to remove or reduce the oxygen to which the food is exposed. Moreover, particularly with meats and cheese, the removal of trace amounts of oxygen can provide additional shelf life at the point of purchase.

U.S. Pat. No. 5,766,706 entitled "Gas Scavenging Arrangement" issued on Jun. 16, 1998 to Custer et al. and U.S. Pat. No. 5,954,433 entitled "Reclosable Bag with Improved Opening Feature" have used oxygen scavenging polymers in association with press-to-close zippers. While press-to-close zippers are well-developed and are satisfactory for their intended purposes, these zippers sometimes do not engage as securely as is desired for some applications.

Moreover, as oxygen scavenging polymers are relatively expensive, it is advantageous to use as small of a quantity of OSPs as possible in the manufacture of reclosable bags.

OBJECTS AND SUMMARY OF THE INVENTION

It is therefore an object of the present invention to provide zippers for reclosable bags, using materials which reduce the oxygen content in the reclosable bag, while maintaining a low cost of manufacture, particularly by minimizing the amount of oxygen scavenging polymers required.

It is therefore a further object of the present invention to provide zippers for reclosable bags with an increased security of engagement, for increasing strength in holding the contents of the reclosable bag.

These and other objects are attained by providing a slider-operated zipper wherein the profiles are formed with oxygen scavenging polymers in the extruding process. The oxygen scavenging polymer can be a co-extruded layer or can be blended with the other resins to be extruded.

Additionally, the process includes activating the oxygen scavenging polymers at the point of packaging by passing the profile under an ultra-violet light source, effectively starting the scavenging process as the zipper is sealed to the packaging web.

This process can be applied to form fill seal apparatus of all kinds which relate to zippered reclosable packages.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
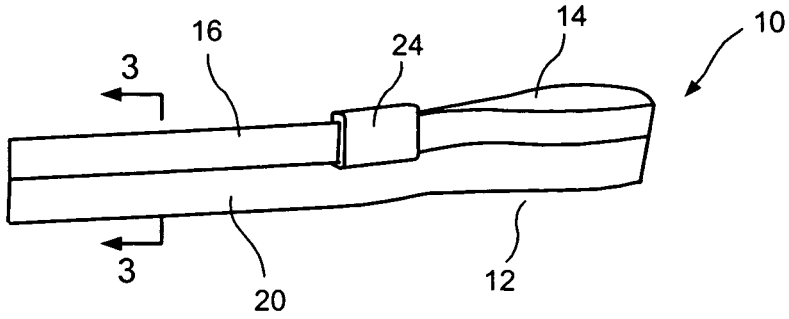
FIG. 1 is a perspective view of a typical embodiment of the zipper of the present invention.
Figure 2:
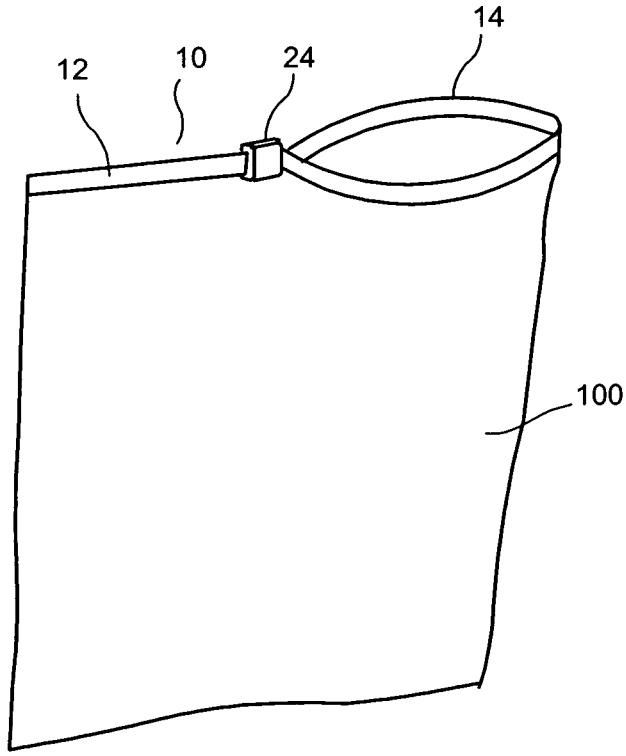
FIG. 2 is a perspective view of a typical embodiment of a reclosable bag, including the zipper of the of the present invention.

Referring now to the drawings in detail wherein like numerals refer to like elements throughout the several views, one sees that FIG. 1 is a perspective view of a typical zipper 10 of the present invention. Likewise, FIG. 2 is a perspective view of a reclosable bag 100, formed from sheets of polymer web, which incorporates the zipper 10 of the present invention.

Zipper 10 includes first and second profiles 12, 14 with first and second interlocking elements 16, 18 and respective first and second flanges 20, 22. Zipper 10 may include optional slider 24 which joins interlocking elements 16, 18 to each other when moved in a first direction and which separates interlocking elements 16, 18 when moved in a second direction. The operation of optional slider 24 is well known in the prior art.

In the illustrated embodiment, first flange 20 includes major portion 30 which extends from first interlocking element 16 to tip 32 and further includes minor portion 34 which extends from tip 32 toward second flange 22, leaving gap 36 therebetween.

This zipper embodiment is intended to be illustrative only. The present invention can be practiced with many different zipper embodiments.

Figure 3:
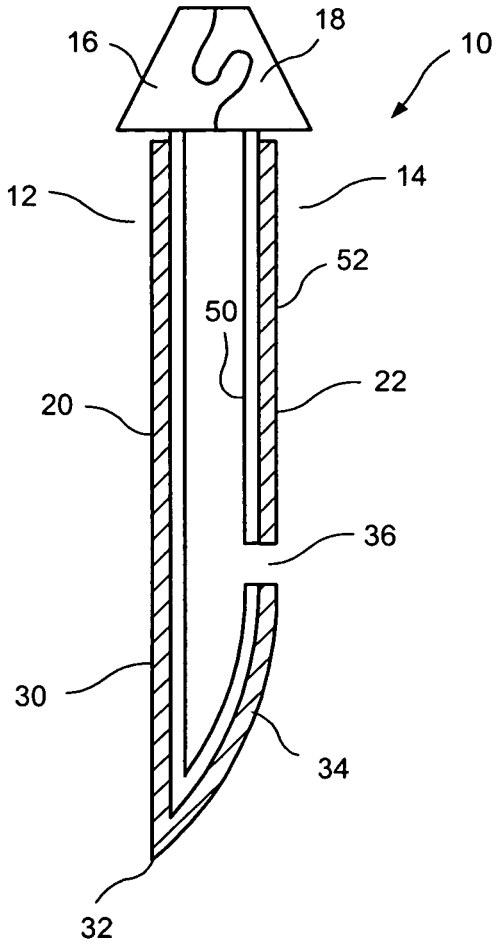
FIG. 3 is a cross-sectional view of a zipper of the present invention along plane 3-3 of FIG. 1, including flanges made from co-extruded layers, with the outer layer being made from oxygen scavenging resins.

In FIG. 3, first and second flanges 20, 22 are illustrated as including an inner layer 50 and an outer layer 52. These layers are co-extruded with outer layer 52 including the oxygen scavenging polymer. Inner layer 50 includes any typical polymer which one skilled in the art would recognize as useful after review of the present disclosure.

Figure 4:
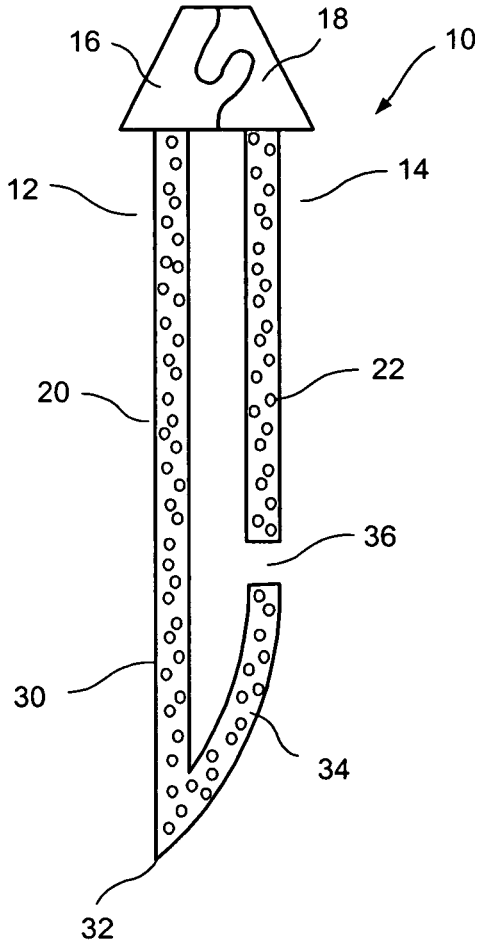
FIG. 4 is a cross-sectional view of a zipper of the present invention along plane 3-3 of FIG. 1, including flanges made from blended polymers, including at least one oxygen scavenging polymer.

In FIG. 4, first and second flanges 20, 22 are illustrated as including a single layer with a blend of resins, including at least one oxygen scavenging polymer.

Figure 5:
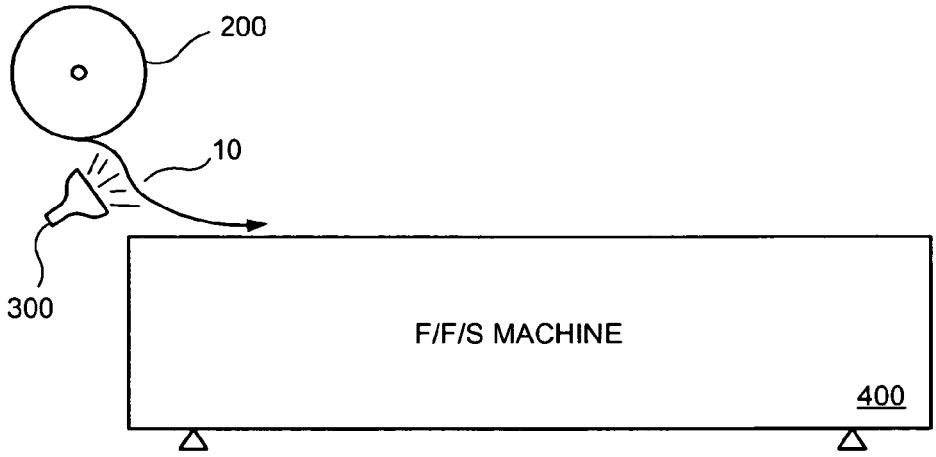
FIG. 5 is a schematic of the feeding of the zipper of the present invention to a form fill seal apparatus, further showing the passing of the zipper by an ultra-violet light source to activate the oxygen scavenging properties.

In FIG. 5, a spool 200 of zipper 10 is provided. Zipper 10 is passed by ultra-violet light 300 to activate the oxygen scavenging polymer immediately prior to use by the form fill and seal apparatus 400 which uses zipper 10 to manufacture a reclosable bag 100, such as is used in the food industry and shown in FIG. 2. Such a configuration reduces the levels of residual oxygen in the reclosable bag 100.

Figure 6:
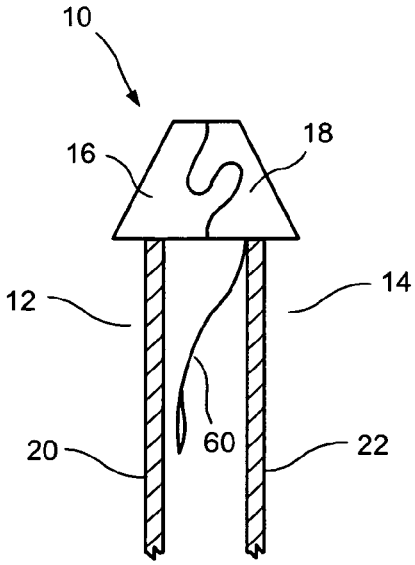
FIG. 6 is a cross-sectional view of a first alternative embodiment which includes a strip of oxygen scavenging polymer attached to the flange.

FIG. 6 is a cross-sectional view of a first alternative embodiment of zipper 10 which includes strip 60 of oxygen scavenging polymer attached to second flange 22 and extending to the contents of the reclosable bag.

Figure 7:
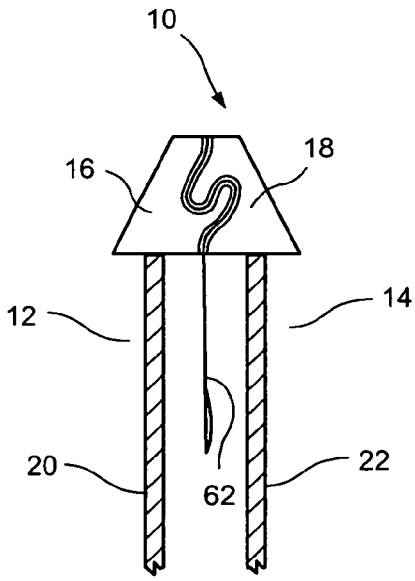
FIG. 7 is a cross-sectional view of a second alternative embodiment which includes a strip of oxygen scavenging polymer attached to one profile and caught between the interlocking elements.

FIG. 7 is a cross-sectional view of a second alternative embodiment which includes a strip 62 of oxygen scavenging polymer attached to first profile 12 and engaged between the interlocking elements 16, 18.

The embodiments of FIGS. 6 and 7 are activated and installed in the same manner as described above.

Such a configuration can be used with form fill seal apparatus of all kinds which employ zippers in the manufacture of reclosable bags or packages, but is particularly useful to form fill seal apparatus which package cheese, meats and similar products in reclosable packages.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package, including:

a first profile including a first interlocking element and a first flange, a second profile including a second interlocking element and a second flange, and a strip with a proximal end and terminating in a distal end, including an oxygen scavenging polymer, wherein the proximal end is attached to and extends from at least one of the first and second flanges and wherein the distal end is a free end which is free of attachment to the first and second flanges.

2. The zipper of claim 1 further including a slider which joins the first and second interlocking elements to each other when moved in a first direction and which separates the first and second interlocking elements from each other when moved in a second direction.

3. The zipper of claim 1 wherein the oxygen scavenging polymer is activated by ultra-violet light prior to installation on a reclosable bag.

4. A zipper for a reclosable package, including:

a first profile including a first interlocking element and a first flange, a second profile including a second interlocking element and a second flange, and a strip, including an oxygen scavenging polymer, attached to one of the first and second interlocking elements, terminating in a free distal end, and engaged between the first and second interlocking elements.

5. The zipper of claim 4 further including a slider which joins the first and second interlocking elements to each other when moved in a first direction and which separates the first and second interlocking elements from each other when moved in a second direction.

6. The zipper of claim 4 wherein the oxygen scavenging polymer is activated by ultra-violet light prior to installation on a reclosable package.

7. The zipper of claim 1 wherein the zipper is provided on a spool.

8. The zipper of claim 3 wherein the zipper is provided on a spool and wherein the oxygen scavenging polymer is activated after the zipper is removed from the spool.

9. The zipper of claim 4 wherein the zipper is provided on a spool.

10. The zipper of claim 6 wherein the zipper is provided on a spool and wherein the oxygen scavenging polymer is activated after the zipper is removed from the spool.

* * * * *

UNITED STATES PATENT AND TRADEMARK OFFICE

CERTIFICATE OF CORRECTION

PATENT NO. : 8,826,498 B2
APPLICATION NO. : 11/442055
DATED : September 9, 2014
INVENTOR(S) : Joel L. Johnson It is certified that error appears in the above-identified patent and that said Letters Patent is hereby corrected as shown below:

On the title page item (75) add the following:

-- Steven Ausnit, New York, NY (US) --

Signed and Sealed this
Twenty-second Day of March, 2016

Michelle K. Lee

Michelle K. Lee
*Director of the United States Patent and Trademark Office*